United States Patent [19]

Bauer

[11] 4,378,026

[45] Mar. 29, 1983

[54] OIL WITHDRAWING APPARATUS

[76] Inventor: Robert K. Bauer, 7150 Torbram Rd., Unit 15, Mississauga, Ontario, Canada, L4T 3Z8

[21] Appl. No.: 273,043

[22] Filed: Jun. 12, 1981

[30] Foreign Application Priority Data

Mar. 16, 1981 [CA] Canada ..... 373117

[51] Int. Cl.[3] ..... F16N 33/00

[52] U.S. Cl. ..... 137/205; 137/355.16; 184/1.5; 141/59

[58] Field of Search ..... 137/205, 355.16; 184/1.5; 141/59, 61

[56] References Cited

U.S. PATENT DOCUMENTS

| | | | |
|---|---|---|---|
| 2,682,886 | 7/1954 | Paxton | 137/205 |
| 2,740,420 | 4/1956 | Hanks | 137/205 |
| 3,095,062 | 6/1963 | Neely | 184/1.5 |
| 3,272,535 | 9/1966 | Neely | 184/1.5 X |

*Primary Examiner*—Alan Cohan

*Attorney, Agent, or Firm*—Schwartz, Jeffery, Schwaab, Mack, Blumenthal & Koch

[57] ABSTRACT

Apparatus for withdrawing a liquid such as oil from a container such as the crankcase of an engine comprising a rigid, fluid-tight receptacle having a circular top wall and an upstanding rim at the periphery thereof, a vacuum line extending from the receptacle for connection to a source of vacuum and having a check valve for preventing backflow of gas, an elongated flexible probe for insertion into the container to take up the liquid, and a conduit divided into two portions and extending from the receptacle to the probe. The first conduit portion extends from the receptacle to a control valve, and the second conduit portion has one end connected to the probe and the other end adapted for selective attachment to and detachment from the control valve. The second conduit portion has an inside diameter large enough to receive the flexible probe and has a length substantially equal to the inner circumference of the receptacle rim so that the probe can be fully inserted into said other end of the second conduit portion and then the second conduit portion can be lodged in circular configuration inside the against the receptacle rim for purposes of storage and transport while maintaining the probe in a protected position.

6 Claims, 3 Drawing Figures

OIL WITHDRAWING APPARATUS

FIELD OF THE INVENTION

This invention relates to apparatus for withdrawing a liquid from a container. More particularly, this application relates to apparatus useful for withdrawing lubricating fluids from relatively inaccessible containers. Specifically, the application relates to apparatus for withdrawing the motor oil from an internal combustion engine or other similar liquid withdrawal tasks.

BACKGROUND OF THE INVENTION

It is well known that lubricating oils used in internal combustion engines lose their effectiveness over a period of time due to accumulation of dirt or other foreign matter therein and due to breakdown of the oil or the additives incorporated therein. In order to prevent excessive engine wear, it is therefore necessary to change the oil at periodic intervals. Typically, the oil is removed from the engine by withdrawing a plug from the oil pan at the bottom of the engine and allowing the oil to run out into some kind of collector. The conventional procedure, however, is disadvantageous in that it is necessary either to have a lift to raise the car above the ground, or to crawl under the car. Not infrequently, the person changing the oil gets all dirty. Also, oil is often spilled, which leaves unsightly stains and pollutes the environment.

For maximum efficiency, it is most desirable that the engine oil be changed while hot. In actual practice, however, the vehicle is usually allowed to sit before the oil is drained therefrom in the conventional fashion. This arises both from the necessity of waiting one's turn to receive service at a service station and also from a desire of a person changing the oil not to be burned with hot oil as he removes the plug from the drain outlet of the oil pan.

Various types of alternative systems have been proposed to avoid draining the oil in the conventional fashion. One system now being marketed involves a pump designed to be driven by a conventional electric hand drill. The suction line of the pump is inserted down the oil dipstick tube and the delivery line is inserted in a suitable container. This system is not satisfactory, however, because it lacks sufficient power to remove the heavy sludge which accumulates at the bottom of the oil pan.

Another system is disclosed in Boyd, et al., U.S. Pat. No. 3,773,091. In this system, a vacuum tank is evacuated by connecting it to the intake manifold of an internal combustion engine. When the pressure in the tank has been reduced to the desired level, the vacuum line is closed off, and a suction line communicating between the drain opening of the oil pan and the tank is opened. Ambient pressure then forces the oil from the drain pan through the line into the evacuated tank. This system is not entirely practical because it requires a permanent connection to the drain opening of the engine oil pan.

A similar system is disclosed in Winkelvoss, U.S. Pat. No. 4,119,117 in which a vacuum tank is connected to the crankcase of an internal combustion engine through a specially designed control valve which shuts off the suction line after all of the oil has been withdrawn. The valve arrangement of Winkelvoss is complex and expensive.

A further problem has arisen in connection with the probe itself, relating to the fact that the probe is somewhat delicate, and can be damaged if it is pinched or bent during normal use, transportation, etc. of the apparatus.

SUMMARY OF THE INVENTION

Accordingly, it is an object of the present invention to provide apparatus for withdrawing a liquid from a container, which apparatus allows convenient storage of the probe in a protected way and yet in a way which makes it immediately and readily accessible to the operator.

A further object of the invention is to provide apparatus for efficiently withdrawing dirty engine oil from the crankcase of an internal combustion engine.

Yet another object of the present invention is to provide apparatus which can remove substantially all of the oil in the crankcase of an internal combustion engine, including the heavy sludge at the bottom of the crankcase.

A further object of the present invention is to provide apparatus which can be conveniently operated without the necessity of lifting or crawling underneath the car.

Still another object of the present invention is to provide an apparatus for withdrawing a liquid from a container, which avoids spillage.

A further object of the present invention is to provide apparatus for withdrawing used engine oil from an internal combustion engine while the oil is hot.

Another object of the present invention is to provide an apparatus meeting the above objects which can be manufactured inexpensively.

These and other objects of the invention are achieved by the providing an apparatus for withdrawing a liquid from a container comprising a rigid, fluid-tight receptacle including bottom and side walls and a substantially circular top wall, an upstanding rim at the periphery of the top wall, a vacuum line for connecting the receptacle to a source of vacuum, check valve means in the vacuum line for preventing backflow of gas therethrough, an elongated, flexible probe for insertion into the container to take up the liquid, a first suction conduit from the receptacle to a control valve, a second suction conduit having one end connected to the probe and having the other end adapted for selective attachment to and detachment from the control valve, the second suction conduit having an inside diameter large enough to receive the flexible probe, and having a length substantially equal to the inner circumference of the receptacle rim such that the probe can be inserted fully into the other end of the second suction conduit, and the second suction conduit can be lodged inside and against the rim for purposes of storage and transport In a preferred embodiment, the inlet probe is an elongated flexible tubular probe sized to pass through the dipstick tube of an internal combustion engine. The intake manifold of the internal combustion engine may be utilized as the vacuum source.

BRIEF DESCRIPTION OF THE DRAWINGS

A preferred embodiment of the invention is illustrated in the accompanying drawings, in which like numerals denote like parts throughout the several views, and in which.

DETAILED DESCRIPTON OF A PREFERRED EMBODIMENT

Figure 1:
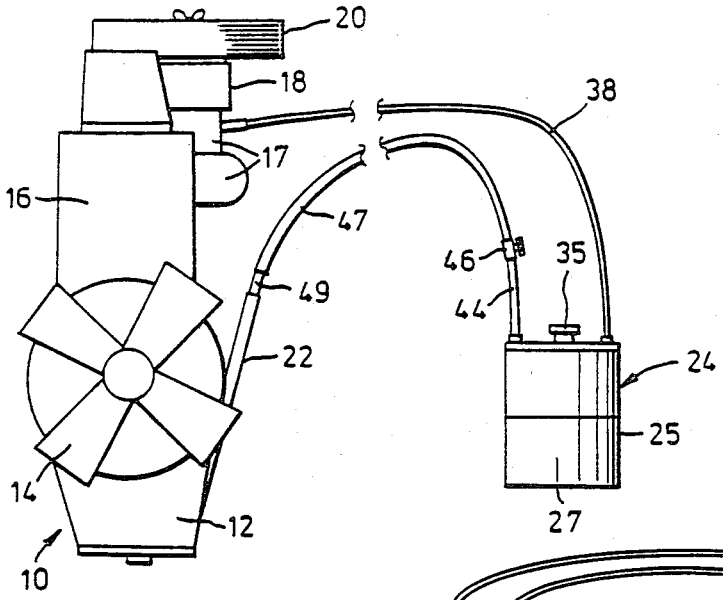
FIG. 1 is a front elevational view of an internal combustion engine showing the apparatus of this invention connected thereto.

In FIG. 1, an internal combustion engine shown generally at 10 is seen to include a crankcase 12 which normally contains engine oil, a fan 14, an engine head 16, an intake manifold 17, a carburetor 18 and an air filter 20. The internal combustion engine 10 also includes a dipstick tube 22.

Figure 2:
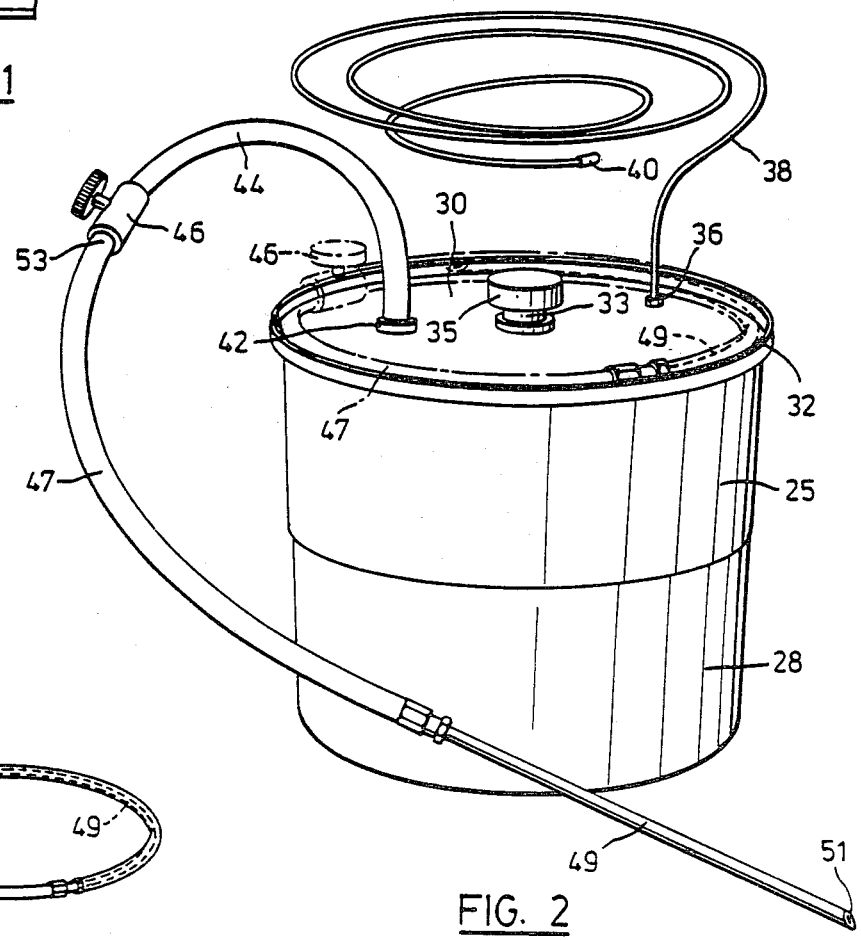
FIG. 2 is a perspective view of the apparatus of this invention, showing its different components.

The apparatus of this invention is best shown in FIGS. 1 and 2. The apparatus for withdrawing oil from the internal combustion engine 10 is generally illustrated by the numeral 24, and includes a rigid, fluid-tight receptacle 25 having a bottom wall 27, a cylindrical side wall 28 and a substantially circular top wall 30. The top wall 30 has an upstanding rim 32 at its periphery. Thus, the rim 32 is substantially circular as seen in plan. The receptacle 25 has affixed thereto a vacuum gauge which communicates with the interior of the receptacle 25 through a short stem 33.

Preferably, the receptacle 25 is made of sheet metal, such as steel.

Opening through the top wall 30 is a vacuum line connector 36, including a lock nut and a gasket (not shown), to which is attached a vacuum line 38 which may be constituted by a small diameter tube or conduit of known type. At the end of the vacuum line 38 remote from the connector 36 is a connector 40 adapted to affix the vacuum line to a suitable source of vacuum, which in FIG. 1 is shown to be the intake manifold 17 of the internal combustion engine 10.

A further connector 42, including a lock nut and a gasket (not shown), also opens through the top wall 30 of the receptacle 25, and has connected to it a first suction conduit 44 extending from the connector 42 to a control valve 46. In a preferred embodiment, the control valve 46 is a quick-opening valve such as a ball-valve or the equivalent, rather than a threaded needle-type valve.

There is also provided a second suction conduit 47 which has one end connected to a probe 49 later to be described in detail, and has its other end adapted for selective attachment to and detachment from the control valve 46. In FIG. 2, the second conduit 47 is shown attached to the control valve 46.

The probe 49 is an elongated, flexible tube with an oblique end 51, and it is adapted for insertion into any container from which liquid is to be withdrawn. In the case of an internal combustion engine, the diameter of the probe 49 must be small enough to allow the probe 49 to fit into the dipstick tube 22, in the manner shown in FIG. 1.

Figure 3:
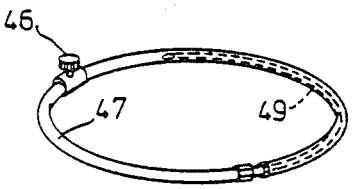
FIG. 3 is a view of one component of the apparatus of this invention, illustrating the way in which it is connected together for storage purposes.

In accordance with this invention, the second suction conduit 47 has an inside diameter large enough to receive the flexible probe 49 in the manner shown in FIG. 3. Moreover, the second suction conduit 47 has a length substantially equal to the inner circumference of the rim 32, so that when the probe is inserted fully into the end 53 of the second suction conduit 47 (after the end 53 has been detached from the valve 46), the conduit 47 will take up an approximately circular shape, which will allow it to be nested inwardly adjacent the rim 32, so that it may be protected from bumps or pinching during normal carrying, etc. of the apparatus. Furthermore, the fact that the probe 49 is itself inserted within the conduit 47 adds a further measure of protection for the probe 49. Thus, there are two protective factors at work to guard the relatively sensitive and delicate probe 49 from serious damage. The probe, which is a sensitive and delicate part of the apparatus, is thus doubly protected. Firstly it is protected by being within the conduit itself, and secondly it is lodged permanently within a rigid rim of the receptacle, along with the conduit itself, thereby preventing accidental knocks, pinching, etc. Another purpose for storing the probe inside the suction line is to protect the user and the environment from being soiled. There will also be some oil in the probe and suction line. Unless the probe is properly stored, oil will run out.

The connector 40 at the end of the vacuum line 38 contains a standard bicycle tire needle valve to prevent backflow of gas therethrough, once it has been withdrawn from the receptacle 25.

In operation, this invention is utilized as follows.

Firstly, the vacuum line 38 is hooked up to the carburetor or intake manifold 17, or to any suitable source of vacuum not necessarily part of the internal combustion engine from which oil is to be withdrawn.

Secondly, valve 46 is closed and the engine with which vacuum line 38 is associated is started. Air is thereby withdrawn from receptacle 25 through connector 36, vacuum line 38 and connector 40 that contains a check valve inside. After the engine has been run for a brief period, which may be short as two minutes or less, it is stopped. The dipstick is then removed and inlet probe 49 is inserted through the dipstick tube 22 until it touches the bottom of the oil pan.

Now, the valve is opened relatively suddenly, which allows the oil to be sucked out. By accomplishing a sudden opening action for the valve 46, there is a sudden application of pressure differential at the bottom end of 51 of the probe 49, which is necessary in order to remove the sludgey oil or heavier deposits located at the bottom of the oil pan. The oil is continuously withdrawn until a slurping sound is heard, which indicates that air is being pulled out. At this point valve 46 is closed, and a period of time is allowed to elapse, so that the rest of the oil in the engine crankcase can drip down and collect around the end 51 of the probe 49.

Valve 46 is once again opened to allow the remaining oil to be sucked out.

Probe 49 is removed from the dipstick inlet and suction conduit 47 is disconnected from valve 46 by means of twisting the hose until it separates from valve 46. Probe 49 is then fully inserted into the end 53 of suction conduit 47. This ring is placed on the top of receptacle 25 within the rim 32.

When the receptacle 25 is full—the container will never be overfilled due to the laws of physics—vacuum line 38 is disconnected from container 25 by means of removing the nut part of connector 36. The nut is then placed on connector 36 after vacuum line 38 has been removed and stored in a convenient location.

The first suction conduit 44 and valve 46 are used as the spout for pouring the oil from the receptacle. Valve 46 is opened and the receptacle is emptied through connector 42, suction conduit 44 and valve 46.

The user also has the option of removing suction conduit 44 and valve 46 by disconnecting the conduit from connector 42 and using connector 42 as the spout for pouring of old oil.

As a further option, it is possible to construct the cover 30 in such a way that it includes a separate pouring spout of about 1½ inches in diameter, with a screw-on cap which is airtight. With such a construction, the method of pouring the oil out of the container would be somewhat modified. The cap would be unscrewed from the pouring spout, and the oil would be poured out through the spout. The connection 36 would allow air into the container to make the pouring of the oil easier. Once the container has been emptied, the cap would be tightened into the pouring spout again, to keep the same airtight for future use.

The foregoing embodiments have been described merely as illustrative examples of the invention and are not intended to be limiting. Since modifications of the specifically described embodiments incorporating the spirit and substance of the invention may occur to persons skilled in the art, the scope of the invention is to be limited solely with respect to the appended claims.

I claim:

1. Apparatus for withdrawing a liquid from a container comprising:

a rigid, fluid-tight receptacle including bottom and side walls and a substantially circular top wall, and an upstanding rim at the periphery of the top wall, a vacuum line for connecting said receptacle to a source of vacuum, a check valve in the vacuum line for preventing backflow of gas therethrough, an elongated, flexible probe for insertion into said container to take up said liquid, a first suction conduit from said receptacle to a control valve, a second suction conduit having one end connected to said probe, and having the other end adapted for selective attachment to and detachment from said control valve, the second suction conduit having an inside diameter large enough to receive said flexible probe, and having a length substantially equal to the inner circumference of said rim such that the probe can be inserted fully into said other end of said second suction conduit, and the latter can be lodged inside and against the said rim for purposes of storage and transport.

2. The apparatus claimed in claim 1, in which the control valve is a quick-opening valve.

3. The apparatus claimed in claim 1 or 2, in which said liquid is motor oil and said container is the oil pan of an internal combustion engine.

4. The apparatus claimed in claim 1 or 2, in which the probe is sized to pass through the dipstick tube of an internal combustion engine, and is long enough to reach the bottom of the oil pan thereof.

5. The apparatus claimed in claim 1 or 2, in which the said vacuum source is the intake manifold of an internal combustion engine.

6. The apparatus claimed in claim 1 or 2, in which said receptacle has sealable opening means for discharging the liquid therefrom.

* * * * *